US010420368B2

(12) United States Patent
Shibagaki et al.

(10) Patent No.: US 10,420,368 B2
(45) Date of Patent: Sep. 24, 2019

(54) METHOD OF MANUFACTURING A TOW BAND

(71) Applicant: DAICEL CORPORATION, Osaka-shi, Osaka (JP)

(72) Inventors: Akiko Shibagaki, Himeji (JP); Nobuaki Kanto, Himeji (JP)

(73) Assignee: DAICEL CORPORATION, Osaka-Shi (JP)

( * ) Notice: Subject to any disclaimer, the term of this patent is extended or adjusted under 35 U.S.C. 154(b) by 0 days.

(21) Appl. No.: 15/521,047

(22) PCT Filed: Nov. 28, 2014

(86) PCT No.: PCT/JP2014/005975

§ 371 (c)(1),
(2) Date: Apr. 21, 2017

(87) PCT Pub. No.: WO2016/084119

PCT Pub. Date: Jun. 2, 2016

(65) Prior Publication Data

US 2017/0265519 A1 Sep. 21, 2017

(51) Int. Cl.

| | |
|---|---|
| ***D01D 5/22*** | (2006.01) |
| ***A24D 3/10*** | (2006.01) |
| ***D02G 1/12*** | (2006.01) |
| ***A24D 3/02*** | (2006.01) |
| ***A24D 3/06*** | (2006.01) |

(52) U.S. Cl.

CPC ..... *A24D 3/10* (2013.01); *A24D 3/0204* (2013.01); *A24D 3/062* (2013.01); *D02G 1/12* (2013.01)

(58) Field of Classification Search

CPC ..... A24D 3/02; A24D 3/0204; D01D 5/22; D02G 1/12

USPC ..... 264/168, 210.2; 28/263

See application file for complete search history.

(56) References Cited

U.S. PATENT DOCUMENTS

| | | | | |
|---|---|---|---|---|
| 2,953,837 A | | 9/1960 | Crawford et al. | |
| 3,571,870 A | | 3/1971 | Dixon et al. | |
| 3,946,469 A | | 3/1976 | Benson | |
| 4,153,064 A | * | 5/1979 | Sawada ..... | A24D 3/14 131/343 |
| 5,225,277 A | | 7/1993 | Takegawa et al. | |

(Continued)

FOREIGN PATENT DOCUMENTS

| | | |
|---|---|---|
| JP | 53-41450 U | 4/1978 |
| JP | 53-86859 A | 7/1978 |

(Continued)

OTHER PUBLICATIONS

Partial Supplementary Search Report dated Dec. 14, 2017, in European Patent Application No. 14907071.6.

(Continued)

*Primary Examiner* — Leo B Tentoni

(74) *Attorney, Agent, or Firm* — Birch, Stewart, Kolasch & Birch, LLP

(57) ABSTRACT

A tow band (TB) for use in a cigarette filter is a tow band in which a plurality of filaments (F) made of cellulose acetate fibers are bundled together and crimped. In the tow band, a filament denier is not less than 6.0 and not more than 11.0, a total denier is not less than 5,000 and not more than 15,000, and a Cv value of the number of crimps of the tow band is not more than 4%.

4 Claims, 6 Drawing Sheets

(56) References Cited

U.S. PATENT DOCUMENTS

| | | | | |
|---|---|---|---|---|
| 6,134,758 | A | 10/2000 | Raskin et al. | |
| 6,924,029 | B1 * | 8/2005 | Caenen | A24D 3/0204 131/331 |
| 2010/0270232 | A1 * | 10/2010 | Iwanaga | B01J 20/28004 210/446 |
| 2010/0294288 | A1 | 11/2010 | Sampson et al. | |
| 2013/0112214 | A1 | 5/2013 | Bundren et al. | |
| 2013/0115452 | A1 | 5/2013 | Bundren et al. | |
| 2014/0026910 | A1 * | 1/2014 | Bundren | B29C 47/12 131/332 |

FOREIGN PATENT DOCUMENTS

| | | | |
|---|---|---|---|
| JP | 3-161542 | A | 7/1991 |
| JP | 7-75542 | A | 3/1995 |
| JP | 9-98762 | A | 4/1997 |
| JP | 2009-275314 | A | 11/2009 |
| JP | 2013-44072 | A | 3/2013 |
| KR | 10-2014-0083050 | A | 7/2014 |
| RU | 2459559 | C2 | 8/2012 |
| WO | WO 2013/042609 | A1 | 3/2013 |
| WO | WO 2013/067503 | A1 | 5/2013 |
| WO | WO 2013/067511 | A2 | 5/2013 |
| WO | WO 2014/154887 | A1 | 10/2014 |

OTHER PUBLICATIONS

Extended European Search Report dated Apr. 18, 2018, in European Patent Application No. 14907071.6.

English translation of the International Preliminary Report on Patentability (Form PCT/IPEA/409), dated Mar. 31, 2017, for International Application No. PCT/JP2014/005975.

English translation of Russian Office Action, dated Nov. 29, 2018, for Russian Application No. 2017122491.

* cited by examiner

METHOD OF MANUFACTURING A TOW BAND

TECHNICAL FIELD

The present invention relates to a cellulose acetate fiber tow band for use in a cigarette filter, a cigarette filter, an apparatus for manufacturing the tow band, and a method of manufacturing the tow band.

BACKGROUND ART

In the description herein, terms "filament", "yarn", "tow band", "filament denier", "total denier", and "packing amount" are defined as described below.

The term "filament" refers to a single fiber (monofilament) that is spun by being pushed out of one spinning hole.

The term "yarn" refers to one fiber bundle (a mass of monofilaments) that is obtained by bundling a plurality of filaments spun by one spinning cabinet together.

The term "tow band" refers to a fiber bundle of a large number of filaments, which is obtained in the following manner: bundling together all the yarns, the number of which is the same as the number of spinning cabinets, i.e., bundling all the filaments spun by a spinning machine together; and performing crimping thereon.

The term "filament denier" refers to the fineness of a filament (monofilament) in terms of a mass (g) per unit length (9000 m). In the description below, the term "filament denier" may be abbreviated as "FD". That is, the FD of a tow band indicates the fineness of each filament forming the tow band.

The term "total denier" refers to the fineness of a tow band in terms of a mass (g) per unit length (9000 m). In the description below, the term "total denier" may be abbreviated as "TD".

The term "packing amount" refers to the net weight of a tow band packed in one filter rod.

As one example, a tow band of cellulose acetate fibers is used as a raw material of a cigarette filter (which is also referred to as a "plug" or "filter tip").

One example of a tow band manufacturing process is as follows. A spinning dope is prepared by dissolving cellulose acetate in an organic solvent. The spinning dope is fed into a spinning machine that includes a plurality of spinning cabinets (towers). The spinning dope is extruded through a large number of spinning holes of spinnerets that are provided for the respective spinning cabinets, and thereby a plurality of filaments are spun. The plurality of filaments are bundled together to form yarns, and then predetermined crimping is performed on the bundled yarns. As a result, a tow band is obtained. Such a tow band and a manufacturing method thereof are disclosed by Patent Literatures 1 and 2, for example.

In the manufacturing of a cigarette filter, for example, a tow band manufactured in the above-described manner is bloomed or opened; a plasticizer such as triacetin is added to the bloomed tow band, which is then formed into a cylindrical shape; rolling paper is wound around the outer periphery of the cylindrical tow band, which is then cut to a predetermined length to form a filter rod; and then the filter rod is further cut to a predetermined length, and thereby a cigarette filter is obtained.

In recent years, consumer preferences for cigarettes have been changing. Cigarettes called "super slim" or "ultra super slim", i.e., cigarettes with a smaller diameter than that of ordinary cigarettes, have been put on the market. For example, Patent Literature 3 discloses a slim cigarette with a diameter of not less than 3.0 mm and not more than 6.0 mm, in which a tow band including filaments with a deformed cross-sectional shape such as a Y-shape is used, and a method of manufacturing a cigarette filter used for the cigarette.

CITATION LIST

Patent Literature

PTL 1: WO2013/067511A1
PTL 2: WO2013/067503A1
PTL 3: WO2013/042609A1

SUMMARY OF INVENTION

Technical Problem

In the manufacturing of a cigarette filter used for a slim cigarette, some technical problems may arise. For example, in case that a tow band intended for use in the manufacturing of an ordinary cigarette filter is compressed and formed so as to conform to the diameter of a slim cigarette, the packing amount of the tow band increases, and thereby the pressure drop (PD) increases. As a result, the cigarette may become less easy to smoke, or the cigarette filter may burst.

In a case where capsules encapsulating a flavor component are embedded in the cigarette filter of a slim cigarette, it is possible that voids within the cigarette filter are filled with these capsules, causing increase in the PD, and as a result, the cigarette may become less easy to smoke.

In recent years, consumers are becoming to prefer even slimmer cigarettes. Therefore, there is a demand for a cigarette that is slimmer than conventional slim cigarettes and yet has a small PD. The PD can be reduced by increasing the FD, for example. However, in a case where the FD of a tow band is, for example, 6.0 or more, packing of the tow band in a slim cigarette in a packing amount suitable for the diameter of the cigarette is difficult unless the TD is reduced. Therefore, there is a demand for a tow band with a high FD and a low TD. However, it has been found that if cigarette filters are manufactured by using such a tow band, the PD greatly varies among the individual cigarette filters. That is, if such cigarette filters are used for manufacturing a plurality of cigarettes, the smoking experience may become unsatisfactory for the smoker because the taste and palatability vary among the individual cigarettes.

The present invention has been made in view of the above-described problems, and an objective of the present invention is to advantageously suppress the PD of a slim cigarette filter.

Solution to Problem

In order to solve the above-described problems, one aspect of the present invention is a tow band in which a plurality of filaments made of cellulose acetate fibers are bundled together and crimped. In the tow band, a filament denier is not less than 6.0 and not more than 11.0, a total denier is not less than 5,000 and not more than 15,000, and a Cv value of the number of crimps of the tow band is not more than 4%.

The term "Cv value" herein is a coefficient of variation expressed as a percentage, which is obtained by dividing a standard deviation by a mean.

Another aspect of the present invention is a tow band manufacturing apparatus including a crimper configured to crimp and feed a yarn that is formed by bundling filaments together and that is fed to the crimper. The crimper includes: a pair of rollers pivotally supported such that peripheral surfaces of the respective rollers face each other; a pair of plate-shaped members positioned following the pair of rollers in a feeding direction of the yarn, the plate-shaped members being placed such that a gap is formed therebetween and such that plate surfaces of the respective plate-shaped members face each other; and an urging member disposed in the gap, the urging member urging the yarn such that the yarn is pressed on the plate surface of one of the pair of plate-shaped members. At least a part of one of the pair of plate-shaped members, the part being adjacent to the pair of rollers, is disposed such that the gap increases gradually in the feeding direction of the yarn.

Yet another aspect of the present invention is a method of manufacturing a tow band. The method includes: a filament spinning step of spinning a plurality of filaments by extruding a spinning dope through a plurality of spinning holes, respectively; and a tow band forming step of forming a tow band by bundling the plurality of filaments together to form a yarn and crimping the yarn. Each of the filaments spun in the filament spinning step has a filament denier of not less than 6.0 and not more than 11.0. The tow band formed in the tow band forming step has a TD of not less than 5,000 and not more than 15,000, and a Cv value of the number of crimps of the tow band is not more than 4%.

Advantageous Effects of Invention

In the tow band and the method of manufacturing the tow band according to the above aspects of the present invention, the FD of each filament is set to be not less than 6.0 and not more than 11.0, the TD of the tow band is set to be not more than 15,000, and the Cv value of the number of crimps of the tow band is suppressed to be not more than 4%. Thus, the FD of each filament is made high, the TD of the tow band is made low, and possible variation in the crimps of the tow band is prevented and uniform crimps are imparted to the entire tow band. By using this tow band, the PD of a cigarette filter can be kept small, and also, variation in the PD can be suppressed.

As a result of studies conducted by the inventors of the present invention, they have obtained the following findings. Assume a case where a crimper used in a tow band manufacturing apparatus includes: a pair of rollers pivotally supported such that peripheral surfaces of the respective rollers face each other; a pair of plate-shaped members positioned following the pair of rollers in a feeding direction of a yarn, the plate-shaped members being placed such that a gap is formed therebetween and such that plate surfaces of the respective plate-shaped members face each other; and an urging member disposed in the gap, the urging member urging the yarn such that the yarn is pressed on the plate surface of one of the pair of plate-shaped members. The inventors of the present invention have found that, in this case, if at least a part of one of the pair of plate-shaped members, the part being adjacent to the pair of rollers, is disposed such that the gap between the pair of plate-shaped members increases gradually in the feeding direction of the filaments, then uniform crimps can be imparted to a tow band even if the FD of each filament is increased or the TD of the tow band is reduced. The tow band manufacturing apparatus according to the above other aspect of the present invention has been realized based on this technical idea.

By using the above tow band manufacturing apparatus, the tow band according to the above one aspect of the present invention can be manufactured.

DESCRIPTION OF EMBODIMENTS

Hereinafter, one embodiment of the present invention is described with reference to the drawings.

<Embodiment>

[Tow Band Manufacturing Apparatus]

Figure 1:
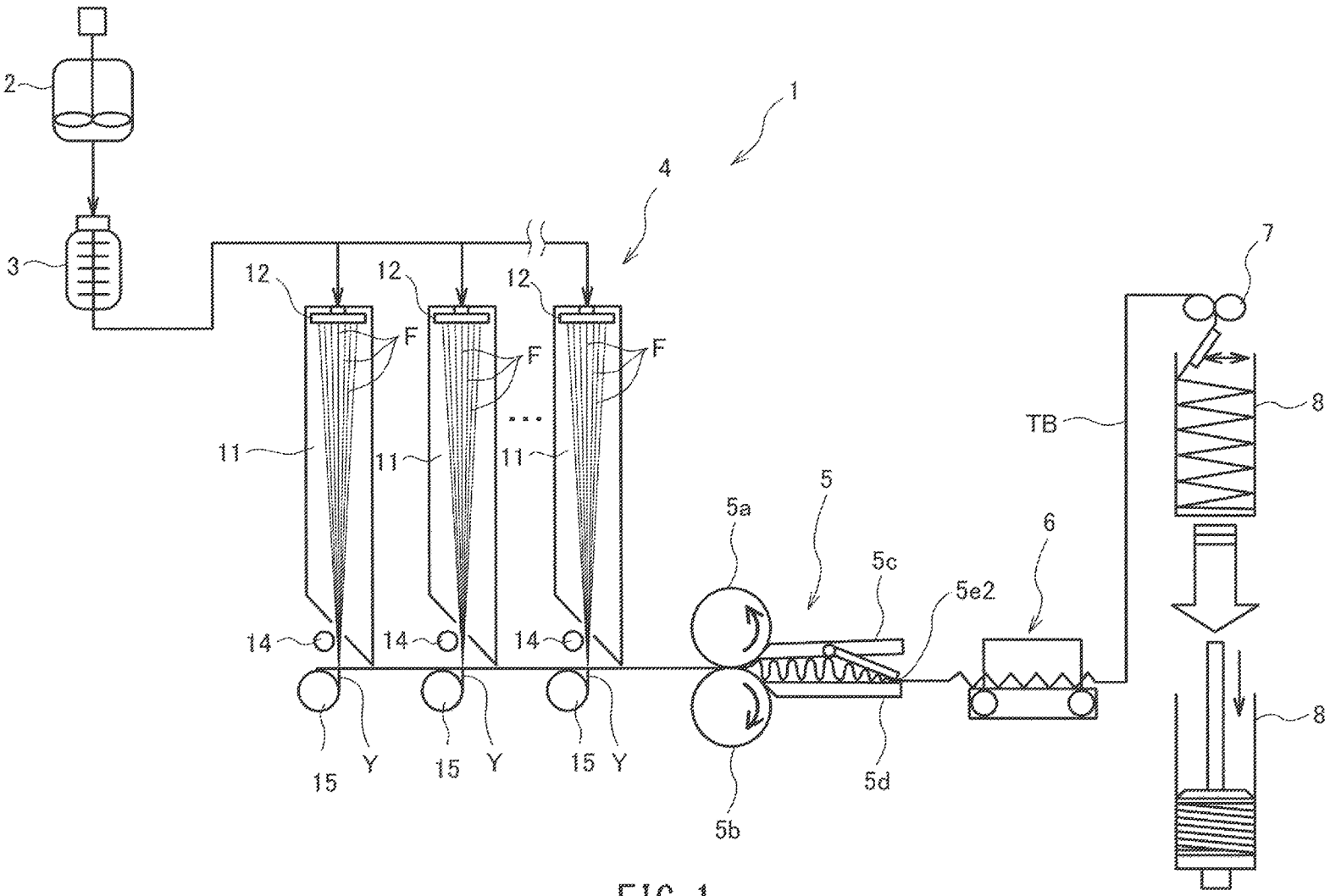
FIG. 1 shows an overall configuration of a tow band manufacturing apparatus according to one embodiment.
Figure 2:
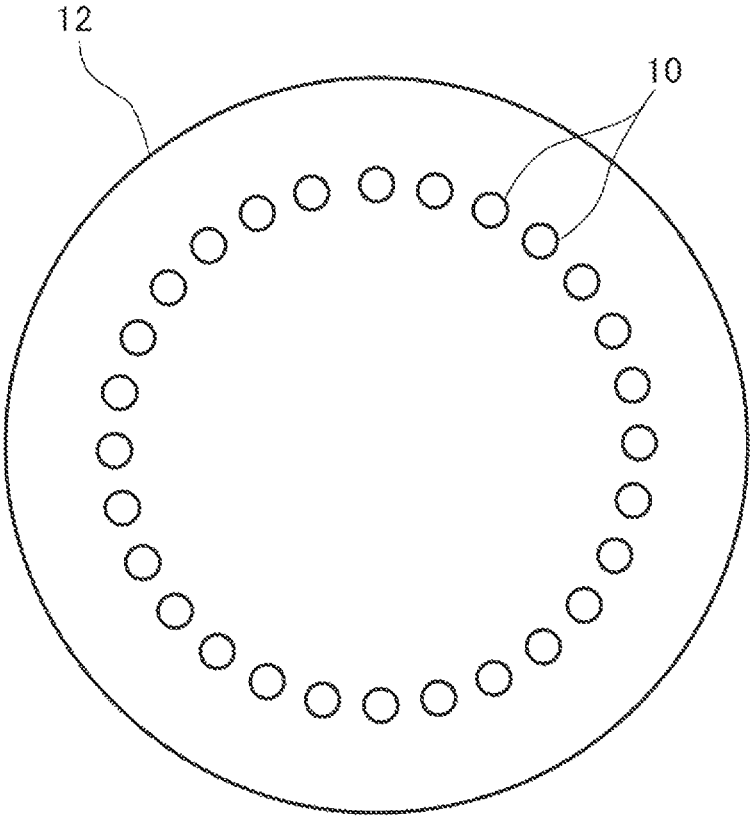
FIG. 2 is a front view showing a configuration of a spinneret of a spinning cabinet.

FIG. 1 shows an overall configuration of a tow band manufacturing apparatus 1 according to the embodiment. FIG. 2 is a front view showing a configuration of a spinneret 12 of a spinning cabinet 11.

As shown in FIG. 1, the tow band manufacturing apparatus 1 includes: a mixer 2; a filter 3; a spinning machine 4; a crimper 5; a dryer 6 for drying a tow band TB formed in the crimper 5 by removing a residual solvent and water from the tow band TB; a pair of feeding rollers 7; and a baler 8 for folding the dried tow band TB into a bale and packing the tow bale in a packing box.

The mixer 2 includes a vessel and a stirrer disposed in the vessel, and mixes a spinning dope charged into the vessel. The spinning dope contains raw materials of filaments F. In the present embodiment, the mixer 2 is used for the purpose of preparing the spinning dope, which is used for spinning cellulose acetate fibers as filaments F by the spinning machine 4. The filter 3 filters the spinning dope prepared by the mixer 2 to remove impurities from the spinning dope.

The spinning machine 4 includes: a plurality of spinning cabinets 11 arranged side by side; spinnerets 12 provided for the respective spinning cabinets 11; and a spinning pump or spinning pumps (not shown). As shown in FIG. 1 and 2, each spinning cabinet 11 is an elongated cylindrical body, and is disposed such that the axis of the spinning cabinet 11 extends in the vertical direction. Each spinneret 12 is provided at the upper end of a corresponding one of the spinning cabinets 11. A predetermined number of spinning holes 10 are formed in each spinneret 12. The peripheral edge shape of each spinning hole 10 is a round shape.

In a filament spinning step, the spinning machine 4 spins filaments F in accordance with, for example, a dry spinning method, in which the spinning dope is fed into each spinneret 12 by the spinning pump and the spinning dope is extruded downward through the spinning holes 10. Below each spinning cabinet 11 and in the feeding direction of the filaments F, an oiling device 14 and a godet roller 15 are disposed. The oiling device 14 is intended for applying an oil emulsion containing textile oil and water to a yarn Y, which is formed by bundling the filaments F together. The godet roller 15 is pivotally supported and intended for bundling the filaments F together to form the yarn Y. Accordingly, the filaments F fed downward from the spinneret 12 are bundled together on the peripheral surface of the godet roller 15, and thereby the yarn Y is formed. The oiling device 14 applies the oil emulsion to the formed yarn Y. Thereafter, the yarn Y is fed to the crimper 5.

In the tow band manufacturing apparatus 1, through the adjustment of, for example, the peripheral edge shape and the size of each spinning hole 10 of the spinneret 12, the FD of each filament F is adjusted to be in a predetermined range. The FD of the filament F is desirably in the range of not less than 6.0 and not more than 11.0, more desirably not less than 6.0 and not more than 10.0, and yet more desirably not less than 6.0 and not more than 8.0. As one example, the FD is adjusted to 6.0 herein. Also, by forming the peripheral edge shape of each spinning hole 10 to be triangular or round, the cross-sectional shape of each filament F is adjusted to be a substantially Y-shape or a substantially round shape. By using these filaments F with such a cross-sectional shape, the filaments F can be prevented from excessively adhering to each other in the tow band TB, and also, gaps can be formed between the filaments F so that increase in the PD of a cigarette filter manufactured by using the tow band TB can be suppressed.

Moreover, when forming a yarn Y by bundling a plurality of filaments F together on the peripheral surface of each godet roller 15, the number of spinning cabinets 11 is adjusted, and thereby the TD of a resulting tow band TB is adjusted to be in a predetermined range. For example, the TD of the tow band TB is desirably not less than 5,000 and not more than 15,000, and more desirably not less than 7,000 and not more than 12,000. In the present embodiment, as one example, the TD of the tow band TB is set to 12,000. By using the tow band TB with such an adjusted TD, the density of the tow band TB can be suitably reduced, and increase in the PD of a cigarette filter manufactured by using the tow band TB can be suppressed. It should be noted that if the TD of the tow band TB is less than 5,000, it is difficult to impart intended crimps (described below) to the plurality of filaments F. For this reason, in the present embodiment, the lower limit of the TD of the tow band TB is set to 5,000.

[Crimper]

Figure 3:
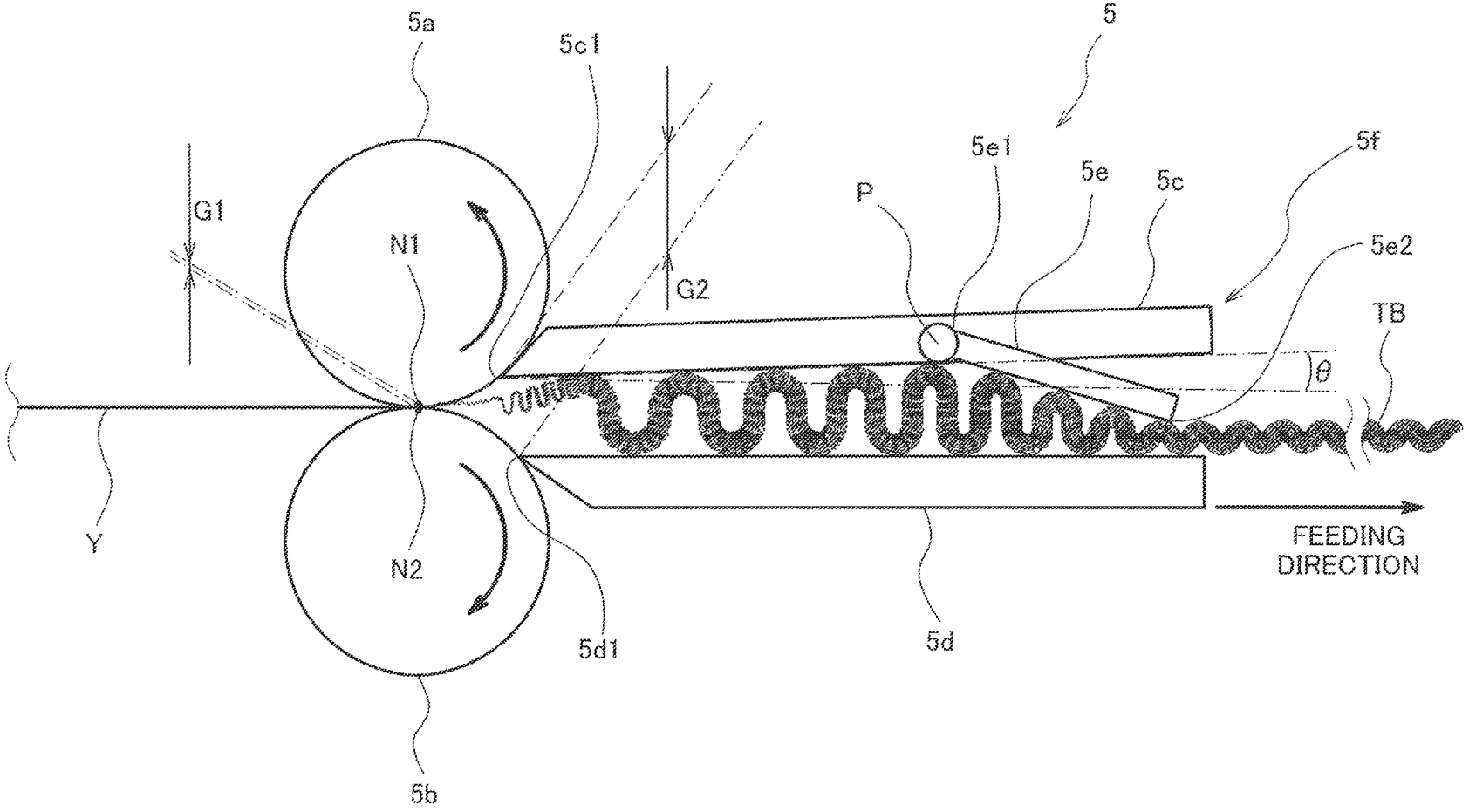
FIG. 3 shows a configuration of a crimper of the tow band manufacturing apparatus together with a peripheral configuration of the crimper.

FIG. 3 shows a configuration of the crimper 5 of the tow band manufacturing apparatus 1 together with a peripheral configuration of the crimper 5. As shown in FIG. 3, the crimper 5 is a stuffer-box crimper, and includes a pair of rollers 5*a* and 5*b*, a pair of plate-shaped members 5*c* and 5*d*, and an urging member 5*e* attached to the plate-shaped member 5*c*. The crimper 5 feeds a bundle of yarns Y (filaments F) from the left to the right in FIG. 3.

The pair of rollers 5*a* and 5*b* is configured as nip rollers (also referred to as "push-in rollers"), which are pivotally supported such that the peripheral surfaces of the respective rollers face each other. In this example, points on the peripheral surfaces of the respective rollers 5*a* and 5*b*, the points facing each other, are defined as nip points N1 and N2. The G1 between the nip points N1 and N2 of the rollers 5*a* and 5*b* may be, for example, set to be equal to the thickness of the tow band TB, which is, for example, not less than 2 mm and not more than 5 mm. The nip pressure applied between the nip points N1 and N2 of the pair of rollers 5*a* and 5*b* may be set to a pressure that is sufficient for introducing a plurality of filaments F into between the pair of plate-shaped members 5*c* and 5*d*.

The pair of plate-shaped members 5*c* and 5*d* is positioned following the pair of rollers 5*a* and 5*b* in the feeding direction of the yarns Y, and placed such that their plate surfaces face each other. As one example, in the crimper 5, the plate-shaped member 5*c* is placed on the upper side, and the plate-shaped member 5*d* is placed on the lower side. The pair of plate-shaped members 5*c* and 5*d* is combined with a pair of vertical side wall members (not shown), and thus a square tubular stuffer box 5*f* is formed.

In a typical crimper, the pair of plate-shaped members is disposed such that they are parallel to each other. However, in the crimper 5, at least a part of one of the pair of plate-shaped members 5*c* and 5*d*, the part being adjacent to the pair of rollers 5*a* and 5*b*, is disposed such that the gap between the pair of plate-shaped members 5*c* and 5*d* increases gradually in the feeding direction of the yarns Y. The "part being adjacent to the pair of rollers 5*a* and 5*b* " herein is, for example, as shown in FIG. 3, a part of one of the pair of plate-shaped members 5*c* and 5*d*, the part including either an end portion 5*c*1 of the plate-shaped member 5*c*, which is the closest portion to the roller 5*a*, or an end portion 5*d*1 of the plate-shaped member 5*d*, which is the closest portion to the roller 5*b*, and extending in the feeding direction of the yarns Y. As one example, in the crimper 5, one of the pair of plate-shaped members 5*c* and 5*d* is disposed to form a slope that extends in the feeding direction of the yarns Y and that is inclined by an inclination angle θ greater than 0° and less than 4°. Specifically, the plate-shaped member 5*d* on the lower side is disposed such that its plate surface extends horizontally, and the plate-shaped member 5*c* on the upper side is disposed to form an upward slope that extends in the feeding direction of the yarns Y and that is inclined upward by the inclination angle θ, which is greater than 0° and less than 4°. As one example, the inclination angle θ is 2.5°. A gap G2 between portions of the pair of plate-shaped members 5*c* and 5*d* , the portions being adjacent to the pair of rollers 5*a* and 5*b*, is set to about 4.5 mm in a general crimper, but set to be not less than 2 mm and not more than 7 mm in the crimper 5. As one example, the gap G2 herein is set to 3 mm. Alternatively, in the crimper 5, the plate-shaped member 5*c* may be disposed such that its plate surface extends horizontally, and the plate-shaped member 5*d* may be disposed to form a downward slope that extends in the feeding direction of the yarns Y and that is inclined downward by the inclination angle θ, which is less than 4°.

The urging member 5*e* urges the yarns Y such that the yarns Y are pressed on the plate surface of one of the pair of plate-shaped members 5*c* and 5*d*. As one example, the urging member 5*e* is configured as an elongated plate-shaped body. As shown in FIG. 3, the urging member 5*e* is disposed such that a side portion 5*e*1, which is one end portion of the urging member 5*e* in its width direction, is connected to the plate-shaped member 5*c*. Accordingly, the urging member 5*e* swings with respect to a swinging center P, which is the connecting point between the urging member 5*e* and the plate-shaped member 5*c*. A side portion 5*e*2, which is the other end portion of the urging member 5*e* in its width direction, is urged by the elastic force of a spring (not shown) in such a direction as to be pressed on to the surface of the plate-shaped member 5*d*. The urging member 5*e* is disposed such that a predetermined crimper pressure can be uniformly applied to a bundle of yarns Y in a direction perpendicular to the feeding direction of the yarns Y. It should be noted that, as one example, the urging member 5*e* may be configured to apply the crimper pressure to the bundle of yarns Y by utilizing hydraulic pressure.

As shown in FIG. 3, in a tow band forming step, in the crimper 5, a bundle of yarns Y fed thereto is passed between the pair of rollers 5*a* and 5*b*. A predetermined nip pressure is applied to the yarns Y between the nip points N1 and N2, and the yarns Y are pushed out of the nip points N1 and N2, so that the yarns Y are crimped. In this manner, the yarns Y are subjected to primary crimping to form fine crimps thereon. Thereafter, the yarns Y are fed into the stuffer box 5*f*. In the space between the pair of plate-shaped members 5*c* and 5*d* facing each other, the space being positioned following the gap G2, the yarns Y are folded while moving in a greatly wavy and serpentine manner, and thereby the yarns Y are crimped to a greater degree (secondary crimping). Thereafter, while the yarns Y are being fed, the urging member 5*e* applies the crimper pressure to the yarns Y, and thereby the yarns Y are crimped to an even greater degree (tertiary crimping). In this manner, in the crimper 5, the yarns Y that have been subjected to the primary crimping are temporarily released in the stuffier box 5*f*, and then the yarns Y are crimped to greater degrees. Thus, by subjecting the yarns Y to such secondary and tertiary crimping, the tow band TB is formed.

Figure 4:
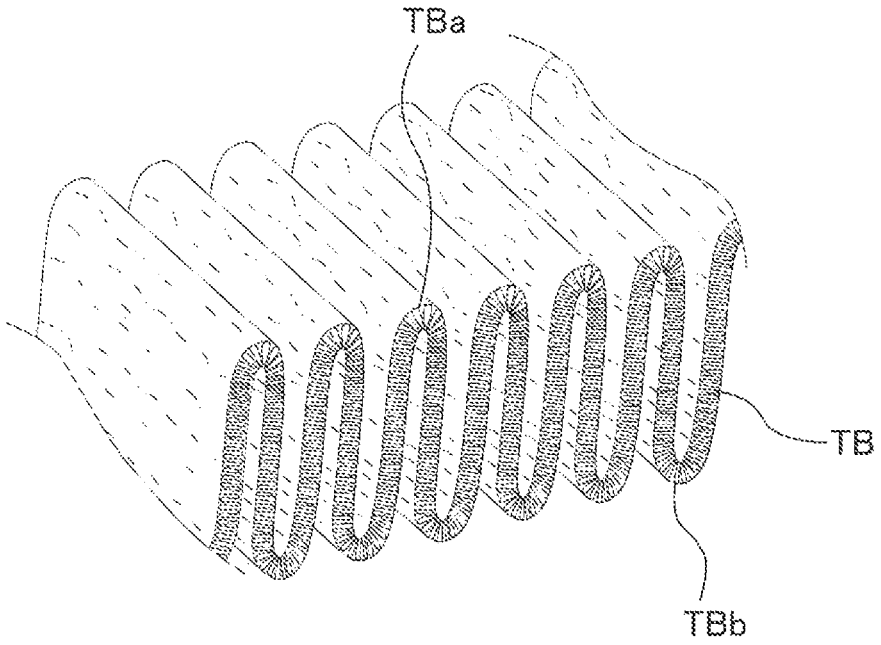
FIG. 4 shows a partial configuration of a tow band.

FIG. 4 is a partially enlarged view showing a configuration of the tow band TB formed in the tow band forming step. As shown in FIG. 4, as a result of the crimping, crest portions TBa and valley portions TBb are formed on the tow band TB alternately in the feeding direction of the yarns Y. It should be noted that, in the crimper 5, the crimping may be performed while spraying water on the peripheral surfaces of the pair of rollers 5*a* and 5*b* to wet the yarns Y.

As one example, in the crimper 5, the yarns Y are crimped such that the number of crimps is not less than 25 crests and not more than 35 crests per 25 mm. "The number of crimps" herein is a numerical value indicating the number of crimps formed through the primary crimping. That is, "the number of crimps" indicates the number of crest portions TBa shown in FIG. 4.

In the crimper 5, the gap G1 between the nip points N1 and N2 is set to be in the range of not less than 2 mm and not more than 5 mm (e.g., 3 mm), and the plate-shaped member 5*c* is disposed such that its plate surface forms an upward slope that extends in the feeding direction of the yarns Y. With this configuration, the tow band TB in which the Cv value of the number of crimps is not more than 4%, i.e., the tow band TB with uniform crimps imparted thereto, can be manufactured. Generally speaking, when the FD of each filament F is increased, greater gaps are formed between the filaments F in the tow band TB, and it is expected that the PD is suppressed. In this case, however, insufficient drying of the filaments F tends to occur in the filament F spinning step. Thus, there has been a limit to increasing the FD of the filament F. On the other hand, when the TD of the tow band TB is reduced, the number of filaments F per unit volume of a cigarette filter manufactured by using the tow band TB is reduced, and consequently, reduction in the PD can be expected to a certain degree. In this case, however, since the volume density of such a tow band TB is low, it is difficult to impart uniform crimps to the bundle of yarns Y.

In this respect, in the tow band manufacturing apparatus 1, since the crimper 5 has the above-described configuration, the Cv value of the number of crimps of the tow band TB (i.e., a value indicating variation in the number of crimps) is suppressed to be not more than 4%. Accordingly, even if the FD of the tow band TB is set to be not less than 6.0 and not more than 11.0, and also, the TD of the tow band TB is set to be not less than 5,000 and not more than 15,000, uniform crimps can be imparted to the entire tow band TB.

After passing through the crimper 5, the tow band TB is dried by the dryer 6. Thereafter, the tow band TB is fed between the pair of rollers 7 and compressed by the baler 8. The compressed tow band TB is folded into a bale, and the tow bale is packed in a predetermined packing box B (see FIG. 5). As one example, the packing box B is transported to a customer. Thereafter, the tow band TB is used in the manufacturing of a filter rod by a filter rod manufacturing apparatus 20.

[Filter Rod Manufacturing Apparatus 20]

Figure 5:
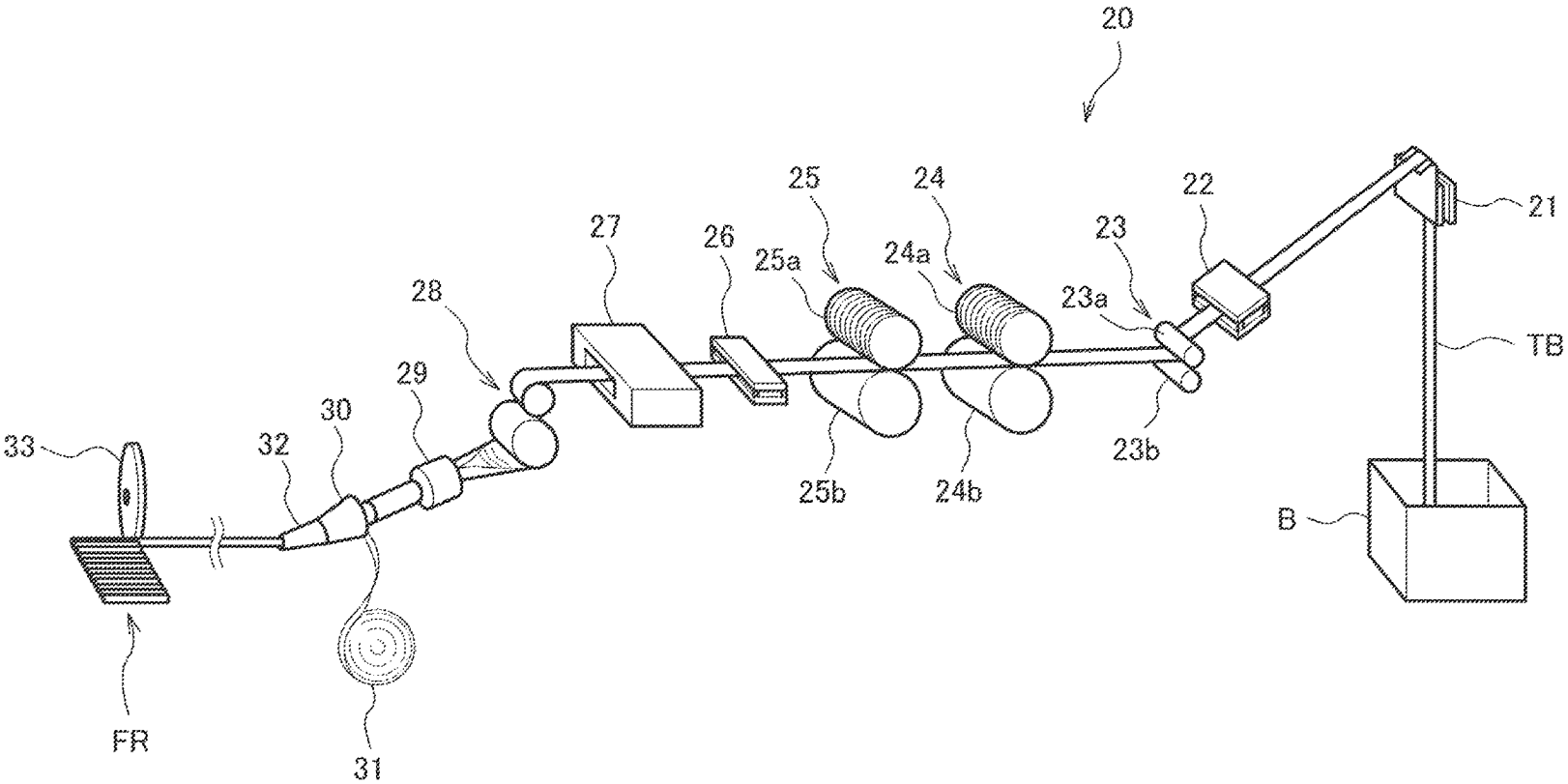
FIG. 5 shows a configuration of a filter rod manufacturing apparatus.

FIG. 5 shows a configuration of the filter rod manufacturing apparatus 20. As shown in FIG. 5, the filter rod manufacturing apparatus 20 includes a first blooming jet device 21, a second blooming jet device 22, pretension rollers 23, first blooming rollers 24, second blooming rollers 25, a third blooming jet device 26, a spray booth 27, feed rollers 28, a feeding jet device 29, a funnel 30, a tube 32, and a rotating blade 33.

In the manufacturing of a filter rod, first, the tow band 1B is drawn from the tow bale in the packing box B, and passed through the first blooming jet device 21 and the second blooming jet device 22 sequentially. In a box of each of the first blooming jet device 21 and the second blooming jet device 22, compressed air is jetted onto the tow band TB while a predetermined tensile strength is being applied to the tow band TB, and thereby the tow band TB is bloomed. In this manner, the width of the tow band TB is adjusted.

Next, the tow band TB is passed between a pair of rollers 23*a* and 23*b* of the pretension rollers 23. At the time, a certain tensile strength is applied to the tow band TB by the pretension rollers 23, and in this state, the tow band TB is passed between a pair of rollers 24*a* and 24*b* of the first blooming rollers 24 and a pair of rollers 25*a* and 25*b* of the second blooming rollers 25 sequentially. By utilizing a difference between the rotational speed of the first blooming rollers 24 and the rotational speed of the second blooming rollers 25, the tow band TB is further bloomed to adjust the width of the tow band TB. Next, the tow band TB is passed through the third blooming jet device 26. In the third blooming jet device 26, the tow band TB is further bloomed in the same manner as in the first blooming jet device 21 and the second blooming jet device 22 to adjust the width of the tow band TB.

After the tow band TB has been sufficiently bloomed by going through the plurality of blooming steps, a plasticizer such as triacetin is sprayed and added to the tow band TB in the spray booth 27. Thereafter, the tow band TB is fed between the feed rollers 28, and the tow band TB is compressed and formed into a cylindrical shape inside the cylindrical feeding jet device 29. Then, the cylindrical tow band TB is fed into the conical funnel 30, in which wrapping paper (serving as tipping paper 42*b* of FIG. 6) drawn from a roll 31 is wound around the outer periphery of the cylindrical tow band TB. Next, inside the tube 32, the wrapping paper is sealed by an adhesive, and the tow band TB and the wrapping paper are cut by the rotating blade 33 to a predetermined length (e.g., about not less than 100 mm and not more than 120 mm). In this manner, a plurality of filter rods FR are manufactured. It should be noted that each of the obtained filter rods FR is further cut to a predetermined length. As a result, a cigarette filter 42*a* of a cigarette 40, which will be described below, is obtained (see FIG. 6).

It should be noted that when the Cv value of the number of crimps of the tow band TB is great, it means that the number of crimps varies from one portion of the tow band TB to the other. The number of crimps of the tow band TB has a direct influence on the PD of a cigarette filter manufactured by using the tow band TB. If the Cv value of the number of crimps of the tow band TB varies, it causes variation in the PD of the cigarette filter manufactured by using the tow band TB (i.e., causes increase in PDCv). Thus, variation in the Cv value of the number of crimps of the tow band TB is a factor causing degradation in the quality of the cigarette filter.

In this respect, in the present embodiment, the tow band TB is configured such that: the FD is not less than 6.0 and not more than 11.0; the TD is not less than 5,000 and not more than 15,000; and the Cv value of the number of crimps is suppressed to be not more than 4%, i.e., uniform crimps are imparted to the tow band TB. This makes it possible to provide a cigarette filter with uniform quality.

[Cigarette]

Figure 6:
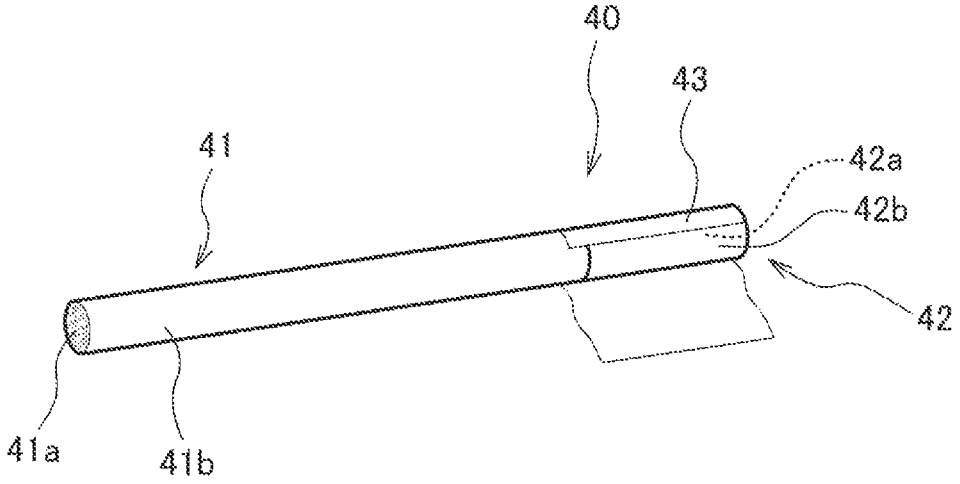
FIG. 6 shows a configuration of a cigarette.

FIG. 6 shows a configuration of the cigarette 40. FIG. 6 includes a partially developed view of rolling paper 43 and shows an internal configuration of the cigarette 40. The cigarette 40 of FIG. 6 according to the present embodiment is a slim-rolled cigarette, and includes a cigarette rod 41, a filter 42, and the rolling paper 43. The cigarette rod 41 includes: a cigarette filler 41*a*, which fills in a cylindrical shape; and rolling paper 41*b* wound around the outer periphery of the cigarette filler 41*a*. The filter 42 includes: the cylindrical cigarette filter 42*a*, which is obtained by cutting the filter rod FR to a predetermined length; and tipping paper 42*b* wound around the outer periphery of the cigarette filter 42*a*. The cigarette filter 42*a* and the tipping paper 42*b* are disposed coaxially with the cigarette rod 41. The rolling paper 43 is wound around a part of the outer periphery of the cigarette rod 41 and the outer periphery of the filter 42, and thus fixes the cigarette rod 41 and the filter 42.

For example, the circumferential length of the cigarette 40 is desirably not less than 14 mm and not more than 17 mm, and more desirably not less than 14 mm and not more than 15 mm. As one example, the circumferential length of the cigarette 40 herein is set to 14.5 mm. Desirably, the length of the cigarette 40 is about not less than 100 mm and not more than 150 mm, for example. As one example, the length of the cigarette 40 herein is set to 100 mm.

It should be noted that a flavor-releasing material such as flavor capsules or an adsorbent such as activated carbon may be contained in the cigarette filter 42*a*. The filter 42 of the cigarette 40 may be formed as a part of a multi-segmented filter that is made up of a plurality of filters.

In the cigarette 40, the cigarette filter 42*a* is formed by using the tow band TB, which has the aforementioned predetermined FD, TD, number of crimps, and Cv value of the number of crimps. Therefore, the PD of the cigarette filter 42*a* is reduced while the cigarette filter 42*a* is formed by using the tow band TB in a predetermined packing amount. Thus, the cigarette 40 is configured such that the PD is sufficiently small and the cigarette is easy to smoke although it is a slim-rolled cigarette.

The Cv value of the PD of the cigarette filter (i.e., a value indicating variation in the pressure drop) depends on the uniformity of the crimps of the tow band TB, and is correlated with the Cv value of the number of crimps of the tow band TB. Accordingly, for example, if the tow band TB includes both a portion in which the number of crimps is large and a portion in which the number of crimps is small, there is a risk that when the tow band TB is compressed and formed into a cigarette filter, voids within the cigarette filter may become blocked up, causing increase in the PD, and in addition, the ease of smoking may vary from cigarette to cigarette. Such problems tend to occur when a tow band TB with a relatively low TD is used in the manufacturing of a slim-rolled cigarette.

In this respect, the cigarette 40 is configured such that the Cv value of the number of crimps of the tow band TB forming the cigarette filter 42*a* is suppressed to be in the range of not more than 4%, and thus uniform crimps are imparted to the entire tow band TB. Accordingly, in the manufacturing of a plurality of cigarettes 40, the PD of each cigarette filter 42*a* is suppressed, and variation in the PD (i.e., PDCv) is suppressed. This makes it possible to manufacture the cigarettes 40 with stable quality, which have uniform taste and palatability, realize gratifying smoking experience, and are easy to smoke.

EXAMPLES

Hereinafter, examples prepared for confirming the performance of the present invention, and performance measurement tests conducted by using these examples, are described.

[Crimp's Dependency on Inclination Angle θ of Plate-Shaped Member and Gap G2 Between Pair of Plate-Shaped Members]

In a state where the gap G2 between the pair of plate-shaped members 5*c* and 5*d* was fixed to 6 mm in the crimper 5, the inclination angle θ of the plate-shaped member 5*c* was varied, and changes in the Cv value (%) of the number of crimps of the tow band TB were observed.

Using the above-described tow band TB, in a state where the inclination angle θ of the plate-shaped member 5*c* was fixed to 1° in the crimper 5, the gap G2 between the pair of plate-shaped members 5*c* and 5*d* was varied, and changes in the Cv value (%) of the number of crimps of the tow band TB were observed.

The tow band TB used in the above performance measurement tests was prepared by using a plurality of filaments F each having a FD of 6.0 and a Y-shaped cross section, and the TD of the tow band TB was set to 15,000. Specifically, the Cv value of the number of crimps of the tow band TB was measured by a tow band crimp number measurement method described below.

(Tow Band Crimp Number Measurement Method)

From an arbitrary part of a bale of the tow band TB, 12 measurement pieces each having a size of 250 mm and serving as a tested portion were randomly taken in the length direction of the tow band TB. The number of crimps of each measurement piece was measured every 25 mm in accordance with a crimp number measurement method stipulated by JIS L 1015 (JIS L 1015 stipulates test methods for man-made staple fibres). Through the measurement, crimp number measurement results were obtained from a total of 120 measurement points on each sample, and based on the obtained crimp number measurement results, the Cv value of the number of crimps was calculated for each sample in accordance with an equation shown below.

$$\text{Cv value (\%) of the number of crimps} = \text{standard deviation/mean}$$

The results of the above calculation are shown in Tables 1 and 2.

TABLE 1

Cv value (%) of the number of crimps in a case where the gap G2 was fixed to 6 mm and the inclination angle θ was varied.

| Samples | Inclination Angle θ [°] | Cv Value of the Number of Crimps [%] |
|---|---|---|
| Comparative Example 1 | −1 | 8.6 |
| Comparative Example 2 | 0 | 6.4 |
| Example 1 | 1.0 | 3.9 |
| Example 2 | 2.5 | 3.1 |

TABLE 1-continued

Cv value (%) of the number of crimps in a case where the gap G2 was fixed to 6 mm and the inclination angle θ was varied.

| Samples | Inclination Angle θ [°] | Cv Value of the Number of Crimps [%] |
|---|---|---|
| Example 3 | 3 | 3.3 |
| Example 4 | 4 | 3.4 |

TABLE 2

Cv value (%) of the number of crimps in a case where the inclination angle θ was fixed to 1° and the gap G2 was varied.

| Samples | Gap G2 [mm] | Cv Value of the Number of Crimps [%] |
|---|---|---|
| Comparative Example 3 | 1 | 8.2 |
| Example 5 | 2 | 3.9 |
| Example 6 | 3 | 3.6 |
| Example 7 | 4 | 3.8 |
| Example 8 | 5 | 3.6 |
| Example 9 | 6 | 3.8 |
| Example 10 | 7 | 3.9 |
| Comparative Example 4 | 8 | 5.5 |

As shown in Table 1, it is clear from the results of Comparative Examples 1 and 2 that in these cases where the inclination angle θ was −1° and 0° (no inclination),the Cv value of the number of crimps was relatively high, and it was difficult to obtain uniform crimps of the tow band TB. Meanwhile, in the cases where the inclination angle θ was increased from 0°, there was a downward trend in the Cv value of the number of crimps. The results in Table 1 show that in any of the cases where the inclination angle θ was 1°, 2.5°, 3°, or 4°, the Cv value of the number of crimps was favorable. The Cv value of the number of crimps was smallest when the inclination angle θ was 2.5°. When the inclination angle θ was 3° or 4°, the Cv value was relatively high, which was, however, still a sufficiently low value. From the results shown in Table 1, it can be considered that the inclination angle θ is preferably greater than 0°, more preferably in the range of 1°<θ<4° as indicated by Examples 1 to 4, and yet more preferably close to 2.5° as particularly indicated by Example 2.

It is clear from the results shown in Table 2 that when the gap G2 was 1 mm as in Comparative Example 3 or when the gap G2 was 8 mm as in Comparative Example 4, the Cv value of the number of crimps was relatively high. Meanwhile, as indicated by Examples 5 to 10, in these cases where the gap G2 was not less than 2 mm and not more than 7 mm, there was a downward trend in the Cv value of the number of crimps. From th results shown in Table 2, it can be considered that the gap G2 is preferably in the range of not less than 2 mm and not more than 7 mm as indicated by Examples 5 to 10, and more preferably close to 3 mm or 5 mm as particularly indicated by Example 6 or 8.

It should be noted that a change in the Cv value of the number of crimps when the gap G2 is varied is less than a change in the Cv value of the number of crimps when the inclination angle θ is varied. Regardless of the value of the inclination angle θ, when the numerical value of the gap G2 is excessively small, it is difficult to impart uniform crimps to the tow band TB, and when the numerical value of the gap G2 is excessively large, the tow band TB tends to be crimped too much, which causes increase in variation in the number of crimps. Therefore, although Table 2 shows the data only in the cases where the inclination angle θ was fixed to 1°, it is estimated that, also in cases where the inclination angleθ is set to an angle different from 1°, the preferable range of the gap G2 is substantially the same as the range shown in Table 2.

[Relationship between FD, TD of Tow Band and PD of Filter]

Next, filter rod samples were manufactured by a manufacturing method described below. First, cellulose diacetate with an average acetylation degree of 55% was dissolved in acetone, and thereby a spinning dope with a concentration of about 25 mass % was prepared. The temperature of the spinning dope was adjusted to be not lower than 40° C. and not higher than 50° C., and then the spinning dope was fed to each spinneret 12. Each of the spinning holes 10 of the spinneret 12 had a triangular shape with a diameter of not less than 7.0 μm and not more than 9.0 μm. The spinning dope was extruded into the spinning cabinets 11 through the respective spinnerets 12, and acetone was evaporated. In this manner, filaments F with a FD of 6.0 and a Y-shaped cross section were spun. An oil emulsion was applied to yarns Y discharged from the respective spinning cabinets 11, and the yarns Y were wound around the respective godet rollers 15. The yarns Y were bundled together, and crimped by using the crimper 5. In this manner, a plurality of tow bands TB with a TD of 17,000 were prepared. In the crimper 5 in a state where the gap G2 was fixed to 2 mm, the inclination angle θ was set to −1°, 0°, or 1°, and crimps were imparted to each tow band TB. At the time, the number of crimps to be imparted was set to 30 crimps per 25 mm. After being crimped, each tow band TB was subjected to a winding (wrapping) process, and filter rod samples each with a packing amount of 0.32 g/rod, a length of 120 mm, and a circumference of 16.7 mm were prepared by using the filter rod manufacturing apparatus 20.

The PD and PDCv of each filter rod sample were measured. The measurement of the PD was performed in the following manner. Air at a temperature of 22±1° C. and with a humidity of 60±1% was passed through each filter rod sample at a flow rate of 17.5 cc per second. At the time, a difference between the pressures at both ends of the filter was measured as a PD in a predetermined unit of measurement, which was [mmWG] (millimeter water gauge). The calculation of the PDCv value was performed in the following manner. One in fifteen filter rod samples was taken for sampling, and 300 samples were taken in total. The PD value of each of the 300 samples was measured, and based on the measured PD values, a Cv value was calculated and expressed as a percentage. These measurement results are shown in Table 3 below.

TABLE 3

| Samples | Gap G2 [mm] | Inclination Angle θ [°] | Cv Value of the Number of Crimps [%] | PD [mmWG] | PDCv [%] |
|---|---|---|---|---|---|
| Comparative Example 5 | 2 | −1 | 6.3 | 505 | 6.1 |
| Comparative Example 6 | 2 | 0 | 4.2 | 512 | 4.3 |
| Example 11 | 2 | 1 | 2.9 | 504 | 2.8 |

The results of Comparative Examples and Example shown in Table 3 confirm that the closer the inclination angle θ gets to 1° from −1°, the more the PD and PDCv of the filter rod are both suppressed. The reason why such results were obtained was that by adjusting the TD to be low and the FD to be high and suppressing the Cv value of the number of crimps, gaps between the filaments F were uniformly and stably formed in the cigarette filter, and thereby the PDCv was reduced. Thus, it is considered that since the PD variation among the cigarette filters is kept small, the cigarette filters with a reduced PD can be manufactured with stable quality.

INDUSTRIAL APPLICABILITY

As described above, one aspect of the present invention has an excellent advantageous effect of being able to favorably suppress the PD of a slim cigarette filter. Therefore, the present invention is useful when widely applied as a cellulose acetate fiber tow band for use in a cigarette filter, a cigarette filter using the cellulose acetate fiber tow band, an apparatus for manufacturing the tow band, and a method of manufacturing the tow band that make it possible to exert the above advantageous effect meaningfully.

REFERENCE SIGNS LIST

F filament
FR filter rod
TB tow band
Y yarn
1 tow band manufacturing apparatus
5 crimper
5*a*, 5*b* nip roller
5*c*, 5*d* plate-shaped member
40 cigarette
42*a* cigarette filter

The invention claimed is:

1. A method of manufacturing a tow band, comprising:

a filament spinning step of spinning a plurality of filaments by extruding a spinning dope through a plurality of spinning holes, respectively; and a tow band forming step of forming a tow band by bundling the plurality of filaments together to form a yarn and crimping the yarn by a crimper, wherein each of the filaments spun in the filament spinning step has a filament denier of not less than 6.0 and not more than 11.0, the crimper includes:

a pair of rollers pivotally supported such that peripheral surfaces of the respective rollers face each other;

a pair of plate-shaped members positioned following the pair of rollers in a feeding direction of the yarn, the plate-shaped members being placed such that a gap is formed therebetween and such that plate surfaces of the respective plate-shaped members face each other; and an urging member disposed in the gap, the urging member urging the yam such that the yarn is pressed on the plate surface of one of the pair of plate-shaped members, in the tow band forming step, settings are made such that the tow band formed in the tow band forming step has a total denier of not less than 5,000 and not more than 15,000, and a Cv value of the number of crimps of the tow band is not more than 4%, and the settings made in the tow band forming step include:

disposing at least a part of one of the pair of plate-shaped members, the part being adjacent to the pair of rollers, such that the gap increases gradually in the feeding direction of the yarn;

disposing the one of the pair of plate-shaped members to form a slope that extends in the feeding direction of the yam and that is inclined relative to the feeding direction by an inclination angle greater than 0° and less than 4°;

setting a smallest gap between the pair of plate-shaped members at the part of the one of the pair of plate-shaped members, the part being adjacent to the pair of rollers, to be not less than 2 mm and not more than 7 mm; and setting a gap between the pair of rollers to be not less than 2 mm and not more than 5 mm.

2. The method of manufacturing a tow band according to claim 1, wherein in the tow band forming step, the number of crimps of the tow band is set to be not less than 30 crests and not more than 35 crests per 25 mm.

3. The method of manufacturing a tow band according to claim 1, wherein the filament denier of each of the filaments spun in the filament spinning step is not less than 6.0 and not more than 8.0.

4. The method of manufacturing a tow band according to claim 1, wherein the total denier of the tow band formed in the tow band forming step is not less than 7,000 and not more than 15,000.

* * * * *